US006655601B2

(12) United States Patent
Yano et al.

(10) Patent No.: US 6,655,601 B2
(45) Date of Patent: Dec. 2, 2003

(54) METHOD FOR PREVENTING HUNTING OF EXPANSION VALVE WITHIN REFRIGERATION CYCLE

(75) Inventors: Masamichi Yano, Tokyo (JP); Masakatsu Minowa, Tokyo (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 10/401,590

(22) Filed: Mar. 31, 2003

(65) Prior Publication Data

US 2003/0183702 A1 Oct. 2, 2003

Related U.S. Application Data

(62) Division of application No. 10/173,654, filed on Jun. 19, 2002, now Pat. No. 6,565,009, which is a continuation of application No. 09/619,476, filed on Jul. 19, 2000, now Pat. No. 6,540,149.

(30) Foreign Application Priority Data

Jul. 19, 1999 (JP) ..... H11-204979

(51) Int. Cl.[7] ..... G05D 27/00
(52) U.S. Cl. ..... 236/92 B; 62/222
(58) Field of Search ..... 236/92 B; 62/225, 62/222, 210

(56) References Cited

U.S. PATENT DOCUMENTS

| | | | | |
|---|---|---|---|---|
| 3,937,439 A | | 2/1976 | Tyler et al. | |
| 4,002,722 A | | 1/1977 | Suzuki et al. | |
| 4,145,384 A | | 3/1979 | Wagaman et al. | |
| 4,819,443 A | | 4/1989 | Watanabe et al. | |
| 4,979,372 A | | 12/1990 | Tanaka | |
| 4,984,735 A | | 1/1991 | Glennon et al. | |
| 5,127,237 A | | 7/1992 | Sendo et al. | |
| 5,228,619 A | * | 7/1993 | Yano et al. | 236/92 B |
| 5,297,728 A | | 3/1994 | Yano et al. | |
| 5,303,864 A | * | 4/1994 | Hirota | 236/92 B |
| 5,361,597 A | * | 11/1994 | Hazime et al. | 62/205 |
| 5,423,480 A | | 6/1995 | Heffner et al. | |
| 5,546,757 A | | 8/1996 | Whipple | |
| 5,732,570 A | | 3/1998 | Tomatsu et al. | |
| 5,943,871 A | * | 8/1999 | Ito et al. | 62/225 |
| 5,957,376 A | * | 9/1999 | Fujimoto et al. | 236/92 B |
| 6,223,994 B1 | | 5/2001 | Fukuda et al. | |

FOREIGN PATENT DOCUMENTS

| | | | |
|---|---|---|---|
| EP | 0559958 | | 9/1993 |
| EP | 0829690 A1 | * | 3/1998 |
| JP | 07-294063 | | 11/1995 |
| JP | 409159324 A | * | 6/1997 |
| JP | 410170106 A | * | 6/1998 |
| JP | 2000-104896 | | 4/2000 |

* cited by examiner

*Primary Examiner*—William E. Tapolcai
*Assistant Examiner*—Mohammad M. Ali
(74) *Attorney, Agent, or Firm*—Rader, Fishman & Grauer PLLC

(57) ABSTRACT

A method for preventing hunting of a thermal expansion valve used to control the flow of refrigerant supplied to an evaporator in a refrigeration cycle. A refrigeration apparatus is provided with a compressor, a condenser, a receiver, an expansion valve, and an evaporator connected in this order, spherically activated carbon made of phenol having pore sizes fit for molecular sizes of a working fluid is prepared; and the spherically activated carbon is provided into the expansion valve; whereby hunting, or the repeated opening and closing of the expansion valve, is prevented.

4 Claims, 5 Drawing Sheets

METHOD FOR PREVENTING HUNTING OF EXPANSION VALVE WITHIN REFRIGERATION CYCLE

The present application is a divisional application of patent application Ser. No. 10/173,654 filed Jun. 19, 2002, now U.S. Pat. No. 6,565,009 which is a continuation of the patent application Ser. No. 09/619,476 filed Jul. 19, 2000.

FIELD OF THE INVENTION

The present invention relates to a thermal expansion valve used for controlling the flow of the refrigerant and for reducing the pressure of the refrigerant being supplied to the evaporator in a refrigeration cycle.

DESCRIPTION OF THE RELATED ART

A conventionally-used thermal expansion valve is formed as shown in FIGS. 4 and 5.

In FIG. 4, a prismatic-shaped valve body 510 comprises a first refrigerant passage 514 to which an orifice 516 is formed, and a second refrigerant passage 519, which are formed independently from each other. One end of the first refrigerant passage 514 is communicated to the entrance of an evaporator 515, and the exit of the evaporator 515 is communicated through the second refrigerant passage 519, a compressor 511, a condenser 512, and a receiver 513 to the other end of the first refrigerant passage 514. A valve chamber 524 communicated to the first refrigerant passage 514 is equipped with a bias means 517, which in the drawing is a bias spring for biasing a spherical valve member 518. The valve member 518 is driven to contact to or separate from an orifice 516. The valve chamber 524 is sealed by a plug 525, and the valve member 518 is biased through a support unit 526. A power element 520 with a diaphragm 522 is fixed to the valve body 510 in a position adjacent to the second refrigerant passage 519. An upper chamber 520*a* formed to the power element 520 and defined by a diaphragm 522 is air-tightly sealed, and within the upper chamber is sealed a temperature-responsive working fluid.

A short pipe 521 extending from the upper chamber 520*a* of the power element 520 is used for the deaeration of the upper chamber 520*a* and the filling of the temperature-responsive working fluid into the chamber 520*a*, before the end portion of the pipe is sealed. The extending end of a valve drive member 523 working as a temperature sensing/transmitting member which starts at the valve member 518 and penetrates through the second refrigerant passage 519 within the valve body 510 is contacted to the diaphragm 522 inside a lower chamber 520*b* of the power element 520. The valve drive member 523 is formed of a material having a large heat capacity, and it transmits the temperature of the refrigerant vapor flowing from the exit of the evaporator 515 through the second refrigerant passage 519, to the temperature-responsive working fluid sealed inside the upper chamber 520*a* of the power element 520, which generates a working gas having a pressure corresponding to the temperature being transmitted thereto. The lower chamber 520*b* is communicated through the gap around the valve drive member 523 to the second refrigerant passage 519 within the valve body 510.

Accordingly, the diaphragm 522 of the power element 520 adjusts the valve opening of the valve member 518 against the orifice 516 (in other words, the quantity of flow of the liquid-phase refrigerant entering the evaporator) through the valve drive member 523 under the influence of the bias force provided by the bias means 517 of the valve member 518, according to the difference in pressure of the working gas of the temperature-responsive working fluid inside the upper chamber 520*a* of the diaphragm and the pressure of the refrigerant vapor at the exit of the evaporator 515 within the lower chamber 520*b*.

According to the thermal expansion valve of the prior art, a problem such as a hunting phenomenon was likely to occur, in which the valve member repeats an opening/closing movement.

In a prior art example aimed at preventing such hunting from occurring, an adsorbent such as an activated carbon is sealed inside a hollow valve driving member.

FIG. 5 is a vertical cross-sectional view showing the prior art thermal expansion valve in which an activated carbon is sealed therein. The basic composition of the valve shown in FIG. 5 is substantially the same as that shown in FIG. 4, except for the structure of a diaphragm and a valve drive member acting as a temperature sensing/pressure transmitting member. In FIG. 5, the thermal expansion valve includes a prismatic-shaped valve body 50, and the valve body 50 comprises a port 52 through which a liquid-phase refrigerant flowing from a condenser 512 via a receiver tank 513 is introduced to a first passage 62, a port 58 for sending out the refrigerant from the first passage 62 to an evaporator 515, an entrance port 60 of a second passage 63 through which a gas-phase refrigerant returning from the evaporator travels, and an exit port 64 for sending out the refrigerant towards a compressor 511.

The port 52 through which the liquid-phase refrigerant travels is communicated to a valve chamber 54 placed above a central axis of the valve body 50, and the valve chamber 54 is sealed by a nut plug 130. The valve chamber 54 is communicated through an orifice 78 to a port 58 for sending out the refrigerant to the evaporator 515. A spherical valve member 120 is placed at the end of a narrow shaft 114 which penetrates the orifice 78. The valve member 120 is supported by a supporting member 122, and the supporting member 122 biases the valve member 120 towards the orifice 78 by a bias spring 124. By moving the valve member 120 and varying the gap formed between the valve and the orifice 78, the passage area of the refrigerant may be adjusted. The liquid-phase refrigerant expands while travelling through the orifice 78, and flows through the first passage 62 and exits from the port 58 to be sent out to the evaporator. The gas-phase refrigerant returning from the evaporator is introduced from the port 60, travels through the second passage 63 and exits from the port 64 to be sent out to the compressor.

The valve body 50 further includes a first hole 70 formed from the upper end of the body along the axis, and a power element 80 is fixed by a screw and the like to the first hole. The power element 80 comprises a housing 81 and 91 which constitute a temperature sensing unit, and a diaphragm 82 being sandwiched between and welded to the housing 81 and 91. Further, an upper end of a temperature sensing/pressure transmitting member 100 acting as a valve drive member is fixed, together with a diaphragm support member 82', to the round hole formed to the center of the diaphragm 82 by welding the whole circumferential area thereof. The diaphragm support member 82' is supported by the housing 81.

The housing 81, 91 is separated by the diaphragm 82, thereby defining an upper chamber 83 and a lower chamber 85. A temperature-responsive working fluid is filled inside the upper chamber 83 and a hollow portion 84. After filling the working fluid, the upper chamber is sealed by a short pipe 21. Further, a plug body welded onto the housing 91 may be utilized instead of the short pipe 21.

The temperature sensing/pressure transmitting member 100 is formed of a hollow pipe-like member exposed to the second passage 63, and to the interior of which is stored an activated carbon 40. The peak portion of the temperature sensing/pressure transmitting member 100 is communicated to the upper chamber 83, and a pressure space 83*a* is defined by the upper chamber 83 and the hollow portion 84 of the temperature sensing/pressure transmitting member 100. The pipe-like temperature sensing/pressure transmitting member 100 penetrates through a second hole 72 formed on the axis line of the valve body 50, and is inserted to a third hole 74. A gap exists between the second hole 72 and the temperature sensing/pressure transmitting member 100, through which the refrigerant inside the passage 63 is introduced to the lower chamber 85 of the diaphragm.

The temperature sensing/pressure transmitting member 100 is inserted slidably to the third hole 74, and the end portion of the member 100 is connected to one end of a shaft 114. The shaft 114 is inserted slidably to a fourth hole 76 formed to the valve body 50, and the end portion of the shaft 114 is connected to a valve member 120.

According to the structure, an activated carbon is utilized, so that the time needed to achieve the temperature-pressure equilibrium between the activated carbon and the temperature-responsive working fluid contributes to stabilize the control characteristics of the refrigeration cycle.

SUMMARY OF THE INVENTION

However, the activated carbon used as the adsorbent in the prior art expansion valves were crushed carbon mainly consisting of palm or coal. The pore sizes of such activated carbon for adsorbing the working fluid are not fixed, so the adsorption quantity differs according to each carbon used. As a result, the temperature-pressure characteristics of each thermal expansion valve may be varied depending on the activated carbon used, which leads to low reliability of the valve.

Therefore, the present invention aims at providing a thermal expansion valve having a constant temperature-pressure characteristics, and which is capable of delaying its response property so as to stabilize the control of the valve. Actually, the present invention aims at providing a thermal expansion valve capable of being stably controlled, by simply changing the adsorbent to be mounted inside the thermal expansion valve, without changing the design of the conventional valve.

In order to achieve the above-mentioned objects, the thermal expansion valve according to the present invention includes a temperature sensing member and a working fluid sealed inside said temperature sensing member, the pressure of said working fluid varying according to temperature, wherein an adsorbent having pore sizes fit for the molecular sizes of said working fluid is placed inside said temperature sensing member.

Moreover, the present invention relates to a thermal expansion valve including a refrigerant passage formed to the interior of said thermal expansion valve which extends from an evaporator to a compressor constituting a refrigerant cycle, and a temperature sensing/pressure transmitting member formed within said passage having a temperature sensing function and comprising a hollow portion formed therein, said thermal expansion valve controlling the opening of a valve according to the temperature of a refrigerant detected by said temperature sensing/pressure transmitting member, wherein a working fluid which varies its pressure according to said temperature is sealed inside said hollow portion, and an adsorbent having pore sizes fit for the molecular sizes of said working fluid is placed inside said hollow portion.

Moreover, the thermal expansion valve of the present invention includes a temperature sensing pipe for sensing the temperature of a refrigerant at the exit of an evaporator constituting a refrigeration cycle, said thermal expansion valve controlling the opening of a valve according to said refrigerant temperature sensed by said temperature sensing pipe, wherein a working fluid which varies its pressure according to said temperature is sealed inside said temperature sensing pipe, and an adsorbent having a pore size fit for the molecular size of said working fluid is placed inside said hollow portion.

Further, the thermal expansion valve of the present invention includes a refrigerant passage formed to the interior of said thermal expansion valve which extends from an evaporator to a compressor, and a temperature sensing/pressure transmitting member formed within said passage having a temperature sensing function and comprising a hollow portion formed therein, wherein the end of said hollow portion of the temperature sensing/pressure transmitting member is fixed to the center opening of a diaphragm constituting a power element for driving said member, an upper pressure chamber formed by said diaphragm to the interior of said power element and said hollow portion being connected to form a sealed space to which a working fluid is sealed, and wherein an adsorbent having pore sizes fit for the molecular sizes of said working fluid is placed inside said hollow portion.

Even further, the thermal expansion valve of the present invention comprises a power element having a diaphragm being displaced according to the change in the pressure transmitted from a heat sensing pipe to which is sealed a working fluid which converts temperature into pressure, and a working shaft contacting said diaphragm at one end and displacing a valve member at the other end, wherein an adsorbent having pore sizes fit for the molecular sizes of said working fluid is placed inside said temperature sensing pipe.

According to the actual embodiment of the thermal expansion valve of the present invention, the adsorbent placed inside the valve is an activated carbon made of phenol.

Moreover, according to another preferred embodiment of the thermal expansion valve of the present invention, the adsorbent is an activated carbon having a pore size distribution with a pore radius peak in the range of 1.7 to 5.0 times the molecular size of said working fluid.

The thermal expansion valve being formed as above includes an adsorbent placed inside the temperature sensing member having pore sizes accommodated to the molecular sizes of the working fluid, which is advantageous in that the adsorption quantity of the activated carbon is constant, and the control of the valve may be stabilized.

DETAILED DESCRIPTION OF PREFERRED EMBODIMENTS

One preferred embodiment of the thermal expansion valve according to the present invention will now be explained with reference to the drawings.

Figure 1:
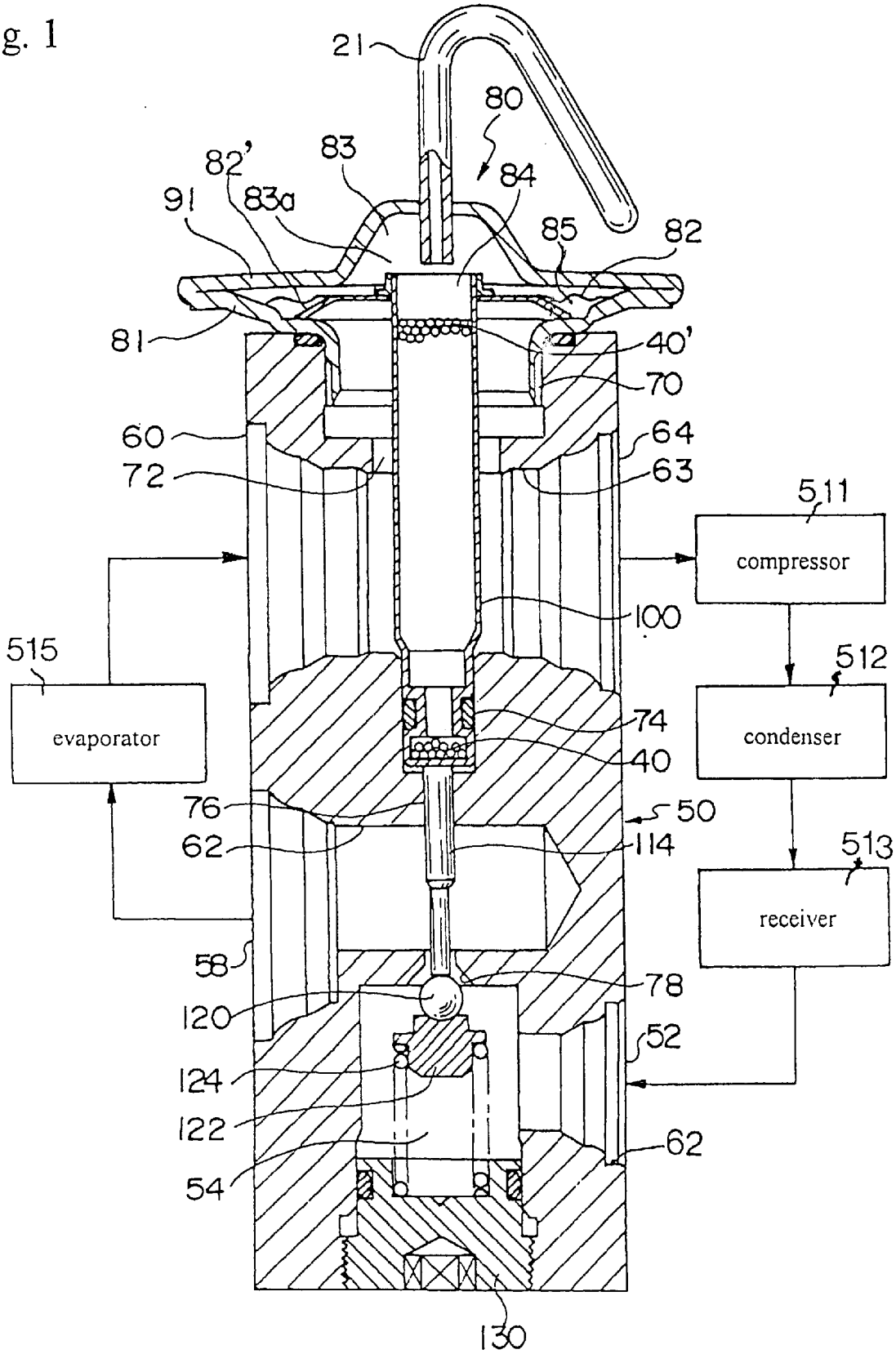
FIG. 1 is a vertical cross-sectional view showing one embodiment of the thermal expansion valve according to the present invention.
Figure 4:
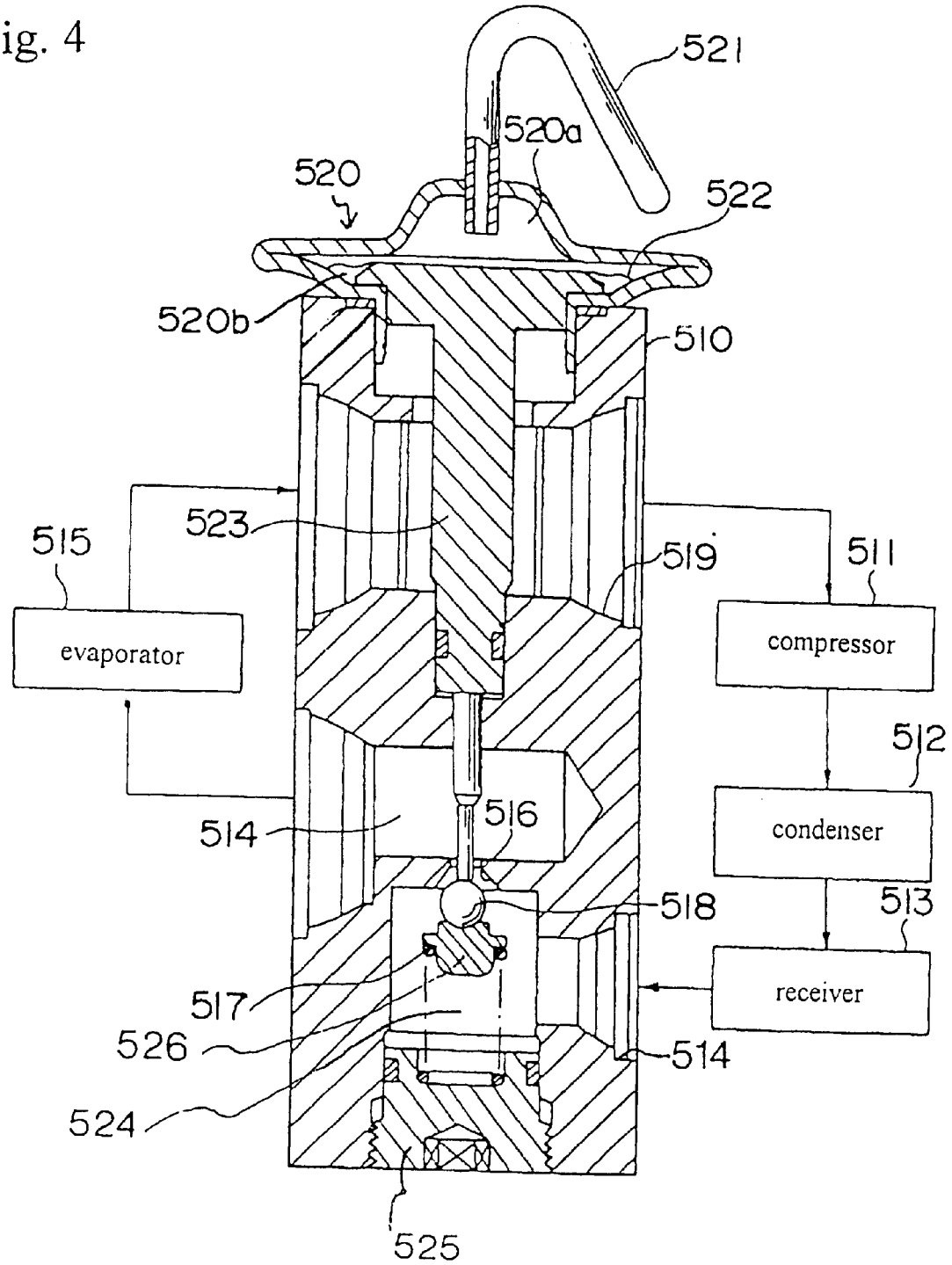
FIG. 4 is a vertical cross-sectional view showing the thermal expansion valve of the prior art.
Figure 5:
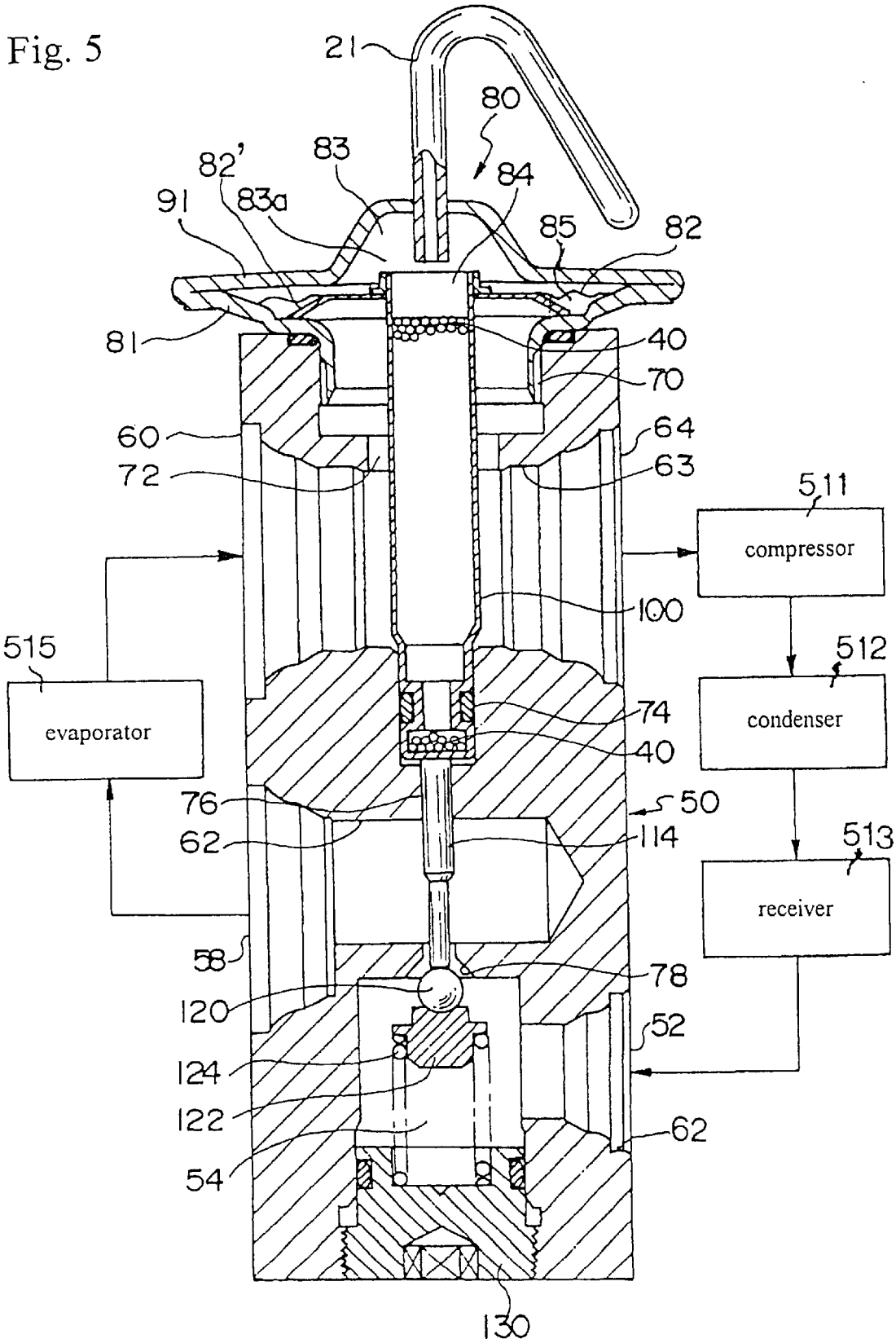
FIG. 5 is a vertical cross-sectional view showing another thermal expansion valve of the prior art.

FIG. 1 is a vertical cross-sectional view showing one embodiment of the thermal expansion valve according to the invention. The thermal expansion valve of the present embodiment differs from the prior art valve shown in FIG. 4 only in the point that the adsorbent placed inside a hollow portion of a hollow valve driving member in the present embodiment differs from that of the prior art. Other structures and members of the present valve are the same as those of the prior art, so the common members are provided with the same reference numbers, and their detailed explanations are omitted.

Figure 2:
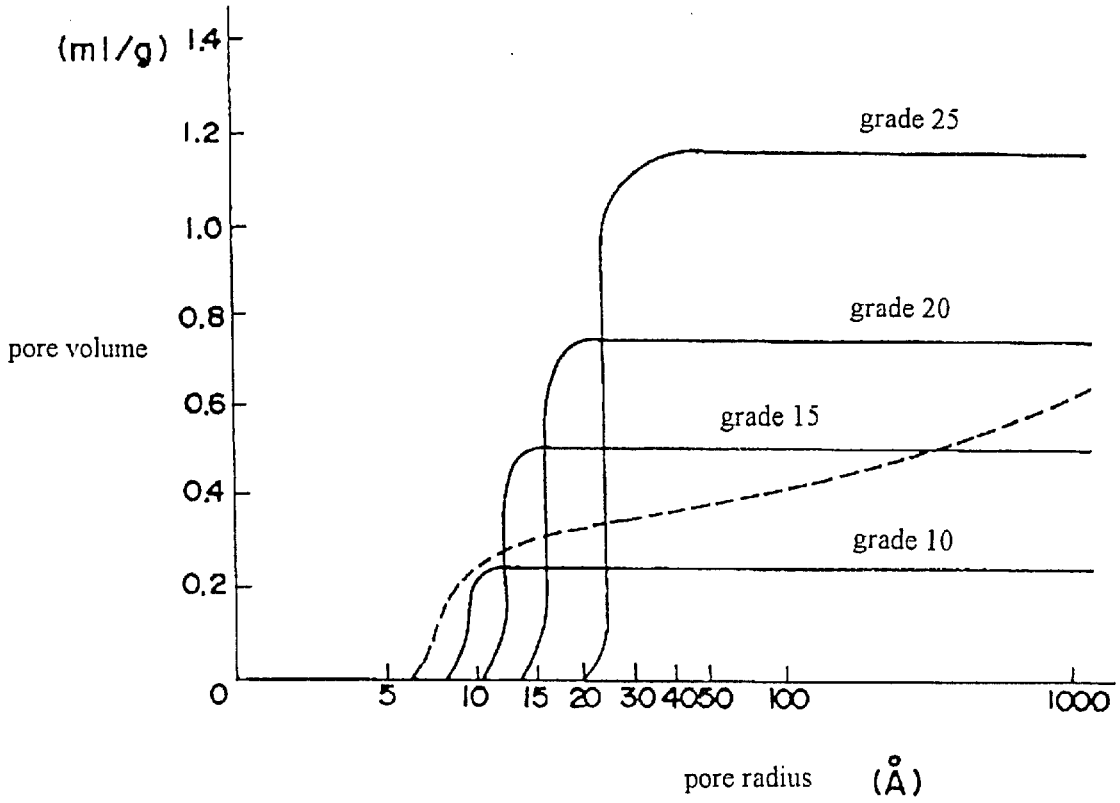
FIG. 2 is a chart showing the characteristics of an activated carbon used in the thermal expansion valve of FIG. 1.

In FIG. 1, reference number 40' shows an adsorbent placed inside a hollow pipe-like member constituting a temperature sensing/pressure transmitting member 100 acting as a valve drive member. According to the present embodiment, the adsorbent 40' is a spherical activated carbon made of phenol. In this embodiment, KURARAY COAL (manufactured by Kuraray Chemical Co., Ltd.) is used. The characteristic curve showing the pore radius sizes (Å) and the pore volume (ml/g) of the spherical activated carbon made of phenol is shown by the continuous line of FIG. 2. In the characteristic curve, grade 10, grade 15, grade 20 and grade 25 correspond to activated carbons made of phenol (KURARAY COAL) having minimum pore radiuses of 9Å, 12Å, 16 Å and 20 Å, respectively, each has a sharp downward peak at the minimum pore radius as shown in FIG. 2. In each of the pore radius groups, the pore volume is regular. In other words, the pore volume is roughly fixed without individual differences between each activated carbon, and therefore, the adsorption quantity of the carbon is also fixed. In contrast, according to an activated carbon made of palm, the pore volumes are not fixed, and therefore, the adsorption quantity is also inconstant.

According to the present embodiment, an activated carbon comprising many pores having sizes corresponding to the molecular sizes of a working fluid is used to adsorb the fluid. According to the embodiment, the adsorption quantity of the carbon is fixed, which leads to stabilized control performance. The activated carbon used in the embodiment comprises pore radiuses which are 1.7–5.0 times the sizes of the molecular of the working fluid, and forms a pore size distribution with a sharp peak as shown in FIG. 2. Accordingly, by using the activated carbon of the present embodiment, a constant adsorption may be performed without any noticeable difference of performance between individual carbons, which leads to realizing a stable valve control. According to one example, a stable control is realized by utilizing a spherical activated carbon made of phenol and classified as group 15, that is, with a pore radius of 12 Å, to adsorb a refrigerant R23 which is trifluoromethane ($CHF_3$) acting as the working fluid and having molecular sizes of 4.1–5.0Å.

Figure 3:
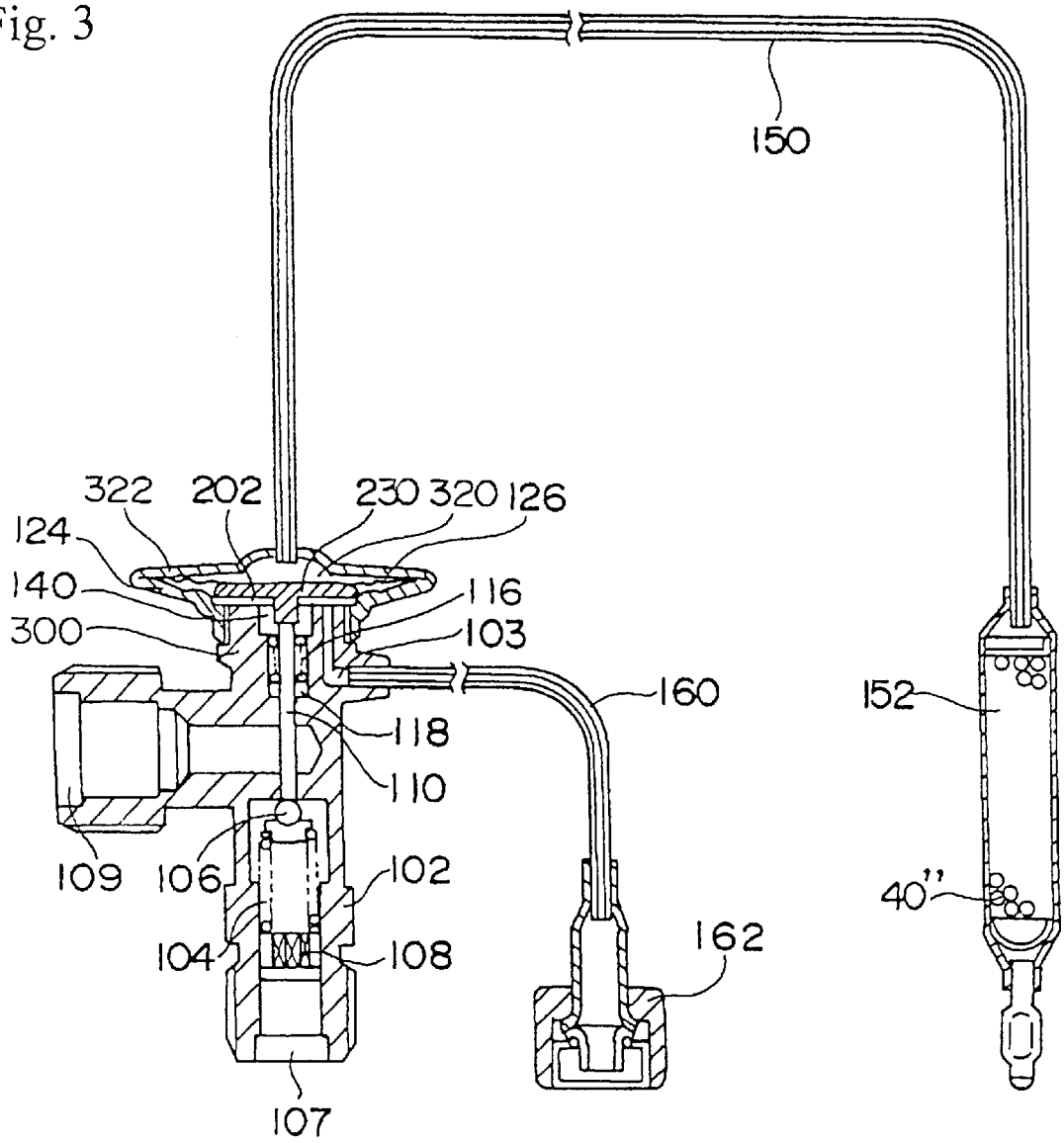
FIG. 3 is a vertical cross-sectional view showing another embodiment of the thermal expansion valve according to the present invention.

The present invention may not only be applied to the thermal expansion valve shown in FIG. 1, but may also be applied to other conventional thermal expansion valves, for example, in which a working fluid sealed inside a temperature sensing pipe varies its pressure according to the temperature. FIG. 3 is a vertical cross-sectional view showing an embodiment of the present invention being applied to such thermal expansion valve. The valve of FIG. 3 comprises a valve unit 300 for decompressing a high-pressure liquid refrigerant, and a power element 320 for controlling the valve opening of the valve unit 300.

The power element 320 includes a diaphragm 126 sandwiched by and welded to the outer peripheral rim of an upper lid 322 and a lower support 124. The upper lid 322 and the diaphragm 126 constitute a first pressure chamber on the upper portion of the diaphragm. The first pressure chamber is communicated via a conduit 150 to the inside of a temperature sensing pipe 152 acting as a temperature sensor. The temperature sensing pipe 152 is mounted to an exit portion of an evaporator, and senses the temperature of the refrigerant close to the exit of the evaporator. The sensed temperature is converted to a pressure P1, which is applied to the first pressure chamber of the power element. When increased, the pressure P1 presses the diaphragm 126 downwards, and provides force in the direction opening the valve 106.

On the other hand, a refrigerant pressure P2 at the exit of the evaporator is directly conducted from a pipe mounting portion 162 through a conduit 160 to a second pressure chamber formed to the lower portion of the diaphragm 126. The pressure P2 is applied to the second pressure chamber 140 formed to the lower portion of the diaphragm 126, and provides force in the direction closing the valve 106 together with the spring force of a bias spring 104. In other words, when the degree of superheat (the difference between the refrigerant temperature at the exit of the evaporator and the evaporation temperature: which may be taken out as force by P1–P2) is large, the valve is opened wider, and when the degree of superheat is small, the opening of the valve is narrowed. As explained, the amount of refrigerant flowing into the evaporator is controlled.

A valve unit 300 includes a valve body 102 comprising a high-pressure refrigerant entrance 107, a low-pressure refrigerant exit 109, and a pressure equalizing hole 103 for connecting a pressure equalizing conduit 132. A stopper member (displacement limiting member) 130 for limiting the displacement of the diaphragm 126 to the lower direction, a working shaft 110 for transmitting the displacement of the diaphragm 126 to the lower direction, restricting members 116 and 118 mounted to the working shaft 110 so as to provide a certain restriction to the movement of the shaft, a valve member 106 (shown as a ball valve in the drawing) positioned so as to contact to or separate from a valve seat, a bias spring 104 and an adjuster 108 for adjusting the biasing force of the spring 104 are assembled to the valve body 102.

According to the thermal expansion valve formed as above, an adsorbent 40" is placed inside the temperature sensing pipe 152. The adsorbent 40" is a spherical activated carbon made of phenol, which is similar to the activated carbon 40' used in the expansion valve of FIG. 1, and which has pore radiuses that are 1.7–5.0 times the molecular sizes of the temperature-responsive working fluid, forming a pore radius distribution with a sharp peak.

By placing the activated carbon 40" inside the temperature sensing pipe 152, the valve may be controlled stably, with a constant temperature-pressure characteristics.

As explained, the thermal expansion valve according to the present invention utilizes an activated carbon having pores with sizes corresponding to the molecular sizes of the temperature-responsive working fluid as the adsorbent, such activated carbon advantageously having very little individual differences. Since the adsorption quantity of such adsorbent is fixed, a thermal expansion valve having a high reliability with a stable control performance may be provided.

Moreover, since there is no major change in design from the conventional thermal expansion valve, the present thermal expansion valve may be manufactured at a relatively low cost.

The contents of Japanese patent application No. 11-204979 filed Jul. 19, 1999 is incorporated herein by reference in its entirety.

We claim:

1. A method for preventing hunting in an expansion valve in a refrigeration cycle of a refrigeration apparatus, said refrigeration apparatus comprising a compressor, a condenser, a receiver, an expansion valve, and an evaporator connected in this order to form the refrigeration cycle, comprising the steps of:

providing spherically activated carbon made of phenol having pore sizes fit for molecular sizes of a working fluid; and controlling adsorption amount of working fluid.

2. A method for preventing hunting in an expansion valve in a refrigeration cycle of a refrigeration apparatus, said refrigeration apparatus consisting of a compressor, a condenser, a receiver, an expansion valve, and an evaporator connected in this order, comprising the steps of:

preparing spherically activated carbon made of phenol having pore sizes fit for molecular sizes of a working fluid; and providing the spherically activated carbon into the expansion valve;

whereby hunting, or the repeated opening and closing of the expansion valve, is prevented.

3. A method for preventing hunting in an expansion valve in a refrigeration cycle of refrigeration apparatus comprising the steps of:

providing said refrigeration apparatus with a compressor, a condenser, a receiver, an expansion valve, and an evaporator connected in this order, preparing spherically activated carbon made of phenol having pore sizes fit for molecular sizes of a working fluid; and providing the spherically activated carbon into the expansion valve;

whereby hunting, or the repeated opening and closing of the expansion valve, is prevented.

4. A method for preventing hunting of expansion valve within a refrigeration cycle of a refrigeration apparatus, said refrigeration apparatus including a refrigerant passage formed to the interior thereof extending from an evaporator to a compressor, and a temperature sensing/pressure transmitting member formed within said passage having a temperature sensing function and comprising a hollow portion formed therein, said thermal expansion valve controlling the opening of a valve according to the temperature of a refrigerant detected by said temperature sensing/pressure transmitting a member, wherein a working fluid which varies its pressure according to said temperature is sealed inside said hollow portion, comprising the steps of:

providing spherically activated carbon made of phenol having pore sizes fit for molecular sizes of the working fluid and controlling adsorption amount of working fluid in a acostant manner.

* * * * *

UNITED STATES PATENT AND TRADEMARK OFFICE

CERTIFICATE OF CORRECTION

PATENT NO. : 6,655,601 B2
DATED : December 2, 2003
INVENTOR(S) : Masamichi Yano et al.

It is certified that error appears in the above-identified patent and that said Letters Patent is hereby corrected as shown below:

Title page,
Item [73], Assignee, should read -- Fujikoki Corporation, Tokyo (JP) --

Signed and Sealed this

Twenty-seventh Day of April, 2004

JON W. DUDAS
*Acting Director of the United States Patent and Trademark Office*